United States Patent [19]

Crucil et al.

[11] Patent Number: 5,002,697

[45] Date of Patent: Mar. 26, 1991

[54] MOLYBDATE-CONTAINING CORROSION INHIBITORS

[75] Inventors: Guy A. Crucil, Bloomingdale; Daniel A. Meier, Naperville, both of Ill.

[73] Assignee: Nalco Chemical Company, Naperville, Ill.

[21] Appl. No.: 438,719

[22] Filed: Nov. 17, 1989

Related U.S. Application Data

[63] Continuation of Ser. No. 168,913, Mar. 15, 1988, abandoned.

[51] Int. Cl.[5] ..... C23F 11/10

[52] U.S. Cl. ..... 252/389.23; 252/389.54; 252/390

[58] Field of Search ..... 252/389.23, 389.54, 252/389.2, 390

[56] References Cited

U.S. PATENT DOCUMENTS

| | | | |
|---|---|---|---|
| 3,803,047 | 4/1974 | Hwa | 252/389 A |
| 3,891,568 | 6/1975 | Nishio et al. | 252/389.22 X |
| 4,143,222 | 3/1979 | Goretta et al. | 526/64 |
| 4,176,059 | 11/1979 | Suzuki | 210/58 |
| 4,181,806 | 1/1980 | Fenyes et al. | 549/6 |
| 4,196,272 | 4/1980 | Gorretta | 526/64 |
| 4,217,216 | 8/1980 | Lipinski | 210/58 |
| 4,246,030 | 1/1981 | Lipinski | 106/14.12 |
| 4,277,359 | 7/1981 | Lipinski | 252/181 |
| 4,298,568 | 11/1981 | Gerhart et al. | 422/16 |
| 4,414,126 | 11/1983 | Wilson | 252/78.3 |
| 4,446,028 | 5/1984 | Becker | 210/697 |
| 4,450,088 | 5/1984 | Wilson et al. | 252/75 |
| 4,487,712 | 12/1984 | Wilson et al. | 252/78.3 |
| 4,502,975 | 3/1985 | Romberger et al. | 252/389 |
| 4,502,978 | 3/1985 | Romberger et al. | 252/389.2 |
| 4,512,552 | 4/1985 | Katayama et al. | 253/389 |
| 4,663,053 | 5/1987 | Geiger | 210/699 |
| 4,692,256 | 9/1987 | Umerura et al. | 252/32.7 |
| 4,703,092 | 10/1987 | Fong | 525/351 |
| 4,728,452 | 3/1988 | Hansen | 252/75 |
| 4,744,949 | 5/1988 | Hoots et al. | 422/15 |
| 4,798,675 | 1/1989 | Lipinski et al. | 210/700 |
| 4,798,683 | 1/1989 | Boffardi et al. | 252/389.54 |

OTHER PUBLICATIONS

Abstract CA 102 (10: 83136x.
Abstract CA 102 (8): 65789h.
Abstract CA 102 (20): 177223e.
Abstract CA 89 (2): 11886g.
Abstract CA 87 (18): 141094s.
Abstract CA 87 (18): 141092a.
Abstract CA 84 (8): 49714j.
Abstract CA 77 (16): 108657y.
Abstract 305242 Eng. Index.
Abstract CA 104 (22): 195382x.
Abstract CA 103 (24): 199307d.
Abstract CA 103 (16): 128728f.
Abstract CA 102 (24): 214292v.
Abstract CA 101 (24): 216171h.
Abstract CA 104 (2): 9526z.
Abstract CA 104 (2): 9313c.
Abstract CA 103 (26): 220528p.
Abstract CA 103 (8): 61407e.
Abstract CA 103 (6): 39583n.
Abstract CA 102 (16: 136235n.
Abstract CA 101 (16): 135001a.
Abstract CA 101 (8): 58603u.
Abstract CA 101 (2): 11341s.
Abstract 1600173 Eng. Index.
Abstract 1549633 Eng. Index.
Abstract 1537510 Eng. Index.
Abstract 1537508 Eng. Index.
Abstract 1519364 Eng. Index.
Abstract 1482151 Eng. Index.
Abstract 1465712 Eng. Index.
Abstract 1413923 Eng. Index.
Abstract 1386368 Eng. Index.
Abstract 1355119 Eng. Index.
Abstract CA 97 (20): 168462d.
Abstract CA 101 (24): 216166k.
Abstract CA 104 (22): 195259n.
Abstract 1627593 Eng. Index.
Abstract CA 92 (14) 116193u.
Abstract CA 101 (4): 26879x.
Abstract CA 105 (8): 64455w.
Abstract CA 104 (18): 1552210x.
Abstract CA 104 (18): 151273h.
Abstract CA 104 (2): 9106n.
Abstract CA 103 (26): 223155a.
Abstract CA 101 (8): 58916y.
Abstract CA 101 (2): 11337v.
Abstract 1398326 Eng. Index.
Abstract 1332905 Eng. Index.
Abstract 1312918 Eng. Index.
Abstract CA 99 (22): 183918s.
Abstract CA 94 (4): 20190f.
Abstract CA 92 (22): 184394k.
Abstract CA 97 (22): 190292v.
Abstract CA 92 (6): 47115f.
Abstract CA 90 (10): 76373c.
Abstract CA 90 (8): 61051x.

*Primary Examiner*—Robert L. Stoll
*Assistant Examiner*—Valerie D. Fee
*Attorney, Agent, or Firm*—Joan I. Norek; Robert A. Miller; Donald G. Epple

[57] ABSTRACT

A process for inhibiting the corrosion of metals in contact with aqueous systems is provided which process comprises adding to such systems an effective amount of a water treatment composition comprising a source of molybdate ion and a water-soluble polymer containing pendant amide functionality.

23 Claims, No Drawings

MOLYBDATE-CONTAINING CORROSION INHIBITORS

This is a continuation of application Ser. No. 07/168,913, filed on Mar. 15, 1988 abandoned.

TECHNICAL FIELD OF THE INVENTION

The present invention is in the technical field of corrosion inhibitors for metals in contact with aqueous systems and in particular corrosion inhibitors useful in industrial cooling water systems. The present invention is particularly useful in industrial recirculating cooling water systems.

BACKGROUND OF THE INVENTION

Compositions useful for inhibiting the corrosion of metals in contact with aqueous systems, such as corrosion inhibitors used in industrial cooling water systems, often contain zinc salts, such as zinc chloride, zinc sulfate, zinc acetate, or the like, which compounds provide, upon dissolution in aqueous systems, the zinc cation to the system. In industrial cooling water systems, and other systems in which corrosion inhibiting compositions are used, the waters employed are often eventually discharged as effluent, and upon such discharge the corrosion inhibitors incorporated therein or by-products of spent corrosion inhibitor systems, may reach natural water systems, such as rivers and lakes and the like. Since zinc compounds generally are toxic to aquatic life, such as fish, it is desirable to minimize the level of zinc compounds in any such effluents, and possibly eliminate zinc compounds completely. Hence it is desirable to provide a process for inhibiting the corrosion of metals in contact with aqueous systems, and composition for such process, which is both effective as a corrosion inhibitor and contains little or no toxic compounds. It is desirable to provide such a process and composition that is effective in industrial aqueous systems employing significant amounts of water, particularly those systems wherein the water employed is eventually discharged as effluent. It is desirable to provide such a process and composition that is effective in industrial cooling water systems, and in particular industrial recirculating cooling water systems, and also controls scale deposits.

DISCLOSURE OF THE INVENTION

The present invention provides a process for inhibiting corrosion of metals in contact with aqueous systems comprising the addition to the water of such aqueous systems an effective amount of a water treatment composition comprising a source of molybdate ion and a water-soluble polymer(s) containing pendant amide functionality, such polymers being primarily derived from acrylamide and alkyl substituted acrylamide containing copolymers/terpolymers with acrylic acid and/or its homologs such as methacrylic acid and the like. The present invention also provides such a composition for water treatment.

PREFERRED EMBODIMENTS OF THE INVENTION

The process of the present invention is directed to the inhibition of corrosion of metals in contact with aqueous systems, and in preferred embodiment is directed to the inhibition of corrosion of metals in contact with cooling water systems. In more preferred embodiment the process is directed to the inhibition of corrosion of metals in contact with recirculating water systems, particularly industrial recirculating water systems, such as industrial recirculating cooling water systems. In this process the water treatment composition is at least added in effective amount to the waters of such systems, and particularly with respect to recirculating water systems is preferably maintained at an effective level within said system. The process inhibits or retards corrosion of metal(s) in contact with the water of such systems, and retards or diminishes the formation of scale deposits within such systems.

The water treatment composition includes a source of molybdate ion, i.e., $MoO_4^{-2}$, preferably an alkali metal salt of molybdate, such as sodium molybdate, although other sources, such as molybdic acid, may be used. It is believed that this component in the present composition has as its active form the oxy anion $MoO_4^{-2}$ and, regardless of the mechanism of the activity of the present composition, it is believed that the present composition may be precisely defined, as to the source of molybdate ion, in terms of the molybdate ion level provided by such source than the amount of such source utilized.

The water treatment composition further includes a water-soluble polymer, or mixture of polymers, containing pendant amide functiontionality, primarily derived from copolymers/terpolymers of acrylamide and/or alkyl substituted acrylamide with acrylic acid and/or its homologs such as methacrylic acid and the like. The pendant amide functionality of such water-soluble polymer may have the general structure of Formula I:

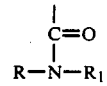

wherein the carbonyl carbon is bonded to the polymer backbone and wherein R and $R_1$ are independently H or alkyl having 1 to 6 carbons, wherein such N-substituted alkyl may be branched or straight chain, and in preferred embodiment one of R and $R_1$ is H and the other is alkyl. In preferred embodiment the water-soluble polymer is a copolymer or terpolymer of from about 25 to 95 mole percent (meth)acrylic acid and from about 5 to 75 mole percent alkyl substituted acrylamide, particularly wherein such alkyl substituted acrylamide provides the pendant amide functionality of Formula I, and more particularly wherein one of R and $R_1$ is alkyl having from 1 to 6 carbons, and the other is H. In a particularly preferred embodiment, the polymer is a copolymer or terpolymer of from 25 to 95 mole percent (meth)acrylic acid and from about 5 to 75 mole percent tertiary butyl acrylamide.

The polymer component of the present water treatment composition is preferably a polymer as described above having a molecular weight of from about 500 to about 100,000, and in further preferred embodiment, particularly when the polymer is a copolymer or terpolymer of (meth)acrylic acid and tertiary butyl acrylamide, and more particularly when such a copolymer or terpolymer within the mole percentage ranges described above for such combination, the molecular weight thereof is from about 500 to 25,000, and more particularly from 10,000 to 20,000.

A particularly useful polymer is a terpolymer of acrylic acid, methacrylic acid, and alkyl substituted acrylamide, in particular such terpolymer of from 25 to 90 mole percent of the acrylic acid and methacrylic acid taken together and from 5 to 75 mole percent of the alkyl substituted acrylamide. In this embodiment, a preferred terpolymer is one derived in pertinent part from an alkyl substituted acrylamide providing the pendant amide functionality of the general Formula I above wherein only one of R and $R_1$ are alkyl, the other being hydrogen (H), and such alkyl having from 1 to 6 carbons.

In further preferred embodiment the alkyl substituted acrylamide monomer from which the polymer is derived is one in which the alkyl substituent has from 1 to 4 carbons, such as methyl acrylamide, ethyl acrylamide, propyl acrylamide, isopropyl acrylamide, n-butyl acrylamide, t-butyl acrylamide, and the like, and a co- or terpolymer of acrylic acid, methacrylic acid, and t-butyl acrylamide having from 40 to 80 mole percent acrylic acid, 0 or from 5 to 40 mole percent methacrylic acid, and from 5 to 40 mole percent t-butyl acrylamide, has been found particularly useful in the water treatment composition, particularly when such co- or terpolymer has a molecular weight of from 500 to 25,000.

The polymer component of the present water treatment composition is believed active as a dispersant, stabilizing calcium carbonate in water systems. For corrosion inhibition with concommitant retardation of scale deposits in aqueous systems dispersant-type polymers commonly are employed in combination with zinc compounds. As discussed above, zinc compounds heretofore used in corrosion inhibition formulations may be too toxic to aquatic life, particularly fish, to be utilized in certain industrial applications where the volume of zinc-containing effluent and the level of zinc within that effluent results in too high of a level of zinc compounds reaching natural water systems. Molybdate compounds, however, are believed of sufficiently low toxicity to aquatic life that in the amounts employed in the process of the present invention, including industrial recirculating cooling water corrosion inhibition process, that the molybdate present in the discharged effluent poses no toxic danger in natural water systems.

The water treatment composition of the present invention may advantageously include other components such as organic phosphonates, water-soluble orthophosphates, azoles such as tolytriazoles and mercaptobenzothiazoles, polycarboxylic acids, and other agents that may provide corrosion inhibition or anti-scale activity or supplement the water treatment composition by providing stabilization for one or more of its components. Such organic phosphonates include organo-phosphonic acids and water soluble salts thereof, such as the alkali metal ammonium salts, and phosphono-carboxylic acids including (poly)phosphono(poly)carboxylic acids, and aminoalkylene phosphonic acids. Specific examples of such organic phosphonates include 1,1-ethylidenediphosphonic acid, 1-hydroxyethylidene-1,1-diphosphonic acid, butylidene diphosphonic acid, 1-aminoethylidene-1,1-diphosphonic acid, amino tri(methylene)phosphonic acid, 2-phosphonobutane 1,2,4-tricarboxylic acid, and the like. Of the foregoing, it has been found that 1-hydroxy ethylidene-1,1-diphosphonic acid (referred to herein as HEDP) and 2-phosphonobutane 1,2,4-tricarboxylic acid (referred to herein as PBTC) are particularly useful components of the present water treatment composition. The water-soluble orthophosphates are sources of the orthophosphate ion ($PO_4^{-3}$) and include phosphoric acid, simple orthophosphate salts, and other compositions that provide the desired level of orthophosphate ion under given use conditions. It is believed that the invention, in any embodiment wherein water-soluble orthophosphates are included in the water treatment composition, may be reasonably defined when such source of orthophosphates is defined in terms of the level of level of orthophosphate ion provided thereby. Particularly useful polycarboxylic acids include the long chain diacids derived from fatty acids such as diacids having a molecular weight of from about 200 to about 1,000. In addition to the foregoing corrosion inhibitors or anti-scale agents, or stabilizers, the water treatment composition of the present invention may include of course suitable solvents or diluents or carriers.

The amount of water treatment composition that is effective in inhibiting corrosion of metals in aqueous systems will vary depending on a number of factors including the type of metal(s) to be protected and the water conditions. In general corrosion inhibition activity in some systems may be provided with as little as 0.5 ppm of molybdate ion combined with 0.5 ppm of the polymer described above, and as a practical upper limit the amounts of these components generally would not need to exceed 200 ppm each. A particularly useful level of water treatment composition, either as a dosage or particularly for recirculating systems as a maintenance level, is from 5 to 150 ppm of molybdate ion and from 5 to 150 ppm of the polymer, with from 10 to 100 ppm of each component being preferred. When additional components are added to the water treatment composition, they may be used at levels similar to that for the molybdate ion and polymer or at lower levels. For instance, HEDP or PBTC may be included at lower or greater levels than the molybdate ion and the polymer taken alone or together, while the azoles and polycarboxylic acids typically, although not necessarily, are included in amounts less than the molybdate ion and the polymer taken alone.

The present water treatment composition is particularly useful in aqueous systems maintained at a pH of from about 7.5 to about 9.0, and at a water temperature of from about 80° to 150° F.

The present water treatment composition in preferred embodiment is one in which no source of zinc ion is employed.

POLYMER

In the following Examples 1 through 6 the term "polymer" used therein refers to a terpolymer of acrylic acid/methacrylic acid/t-butyl acrylamide in respective mole ratios of about 60/20/20 and having a molecular weight of about 14,600.

EXAMPLE 1

Seven-day container tests were conducted to compare corrosion rates in the presence of varying levels of molybdate ion, polymer, and HEDP (hydroxyethylidene diphosphonic acid). In these tests coupons were held immersed in the test water, under constant agitation, for a period of seven days. The test water was held at a pH of 8.5 and had a total alkalinity of 90 ppm (as $CaCO_3$), 70 ppm calcium as $CaCO_3$ and 35 ppm magnesium as $CaCO_3$. Corrosion rates, in mpy (mils per year) were determined for three types of coupons, i.e., copper, admiralty brass, and mild steel. When the copper and admiralty brass coupons were tested, 7.0 ppm tolytriazole was added to the test water. The corrosion rates were calculated based on coupon weight loss after removal of deposits. The results are shown below in Table I.

TABLE I

| Tests | $MoO_4^{-2}$ (ppm) | Polymer (ppm) | HEDP (ppm) | Corrosion Rate (mpy) Copper | Adm. brass | mild steel |
|---|---|---|---|---|---|---|
| a | none | none | none | 0.01 | 0.08 | 18.3 |
| b | none | 100 | none | 0.31 | 0.12 | 16.10 |
| c | 100 | none | none | 0.01 | 0.01 | 1.60 |
| d | 50 | 50 | none | 0.01 | 0.01 | 1.00 |
| e | 100 | 100 | none | 0.03 | 0.03 | 0.50 |
| f | none | 50 | 50 | 0.30 | 0.14 | 3.37 |
| g | none | none | 100 | 0.01 | 0.01 | 1.50 |
| h | none | 100 | 100 | 0.06 | 0.16 | 0.29 |
| i | 100 | none | 100 | 0.01 | 0.10 | 0.10 |
| j | 50 | none | 50 | 0.01 | 0.01 | 0.04 |
| k | 50 | 50 | 50 | 0.20 | 0.18 | 0.61 |
| l | 100 | 50 | 50 | 0.07 | 0.12 | 0.08 |
| m | 50 | 100 | 50 | 0.10 | 0.06 | 0.06 |
| n | 50 | 50 | 100 | 0.01 | 0.15 | 0.41 |
| o | 100 | 100 | 100 | 0.06 | 0.06 | 0.17 |

EXAMPLES 2 and 3

One-day container tests were conducted to compare corrosion rates at varying pH's for two water treatment compositions. In these tests coupons were held immersed in the test water for a one day (24 hour) period with constant agitation. The test water contained 175 ppm calcium and 87 ppm magnesium, and was held at a temperature of about 50° C. The results are reported simply in milligrams of metal loss. Each water treatment composition provided a use level of 10 ppm $MoO_4^{-2}$ (from $Na_2MoO_4$), 15 ppm ortho-$PO_2^{-3}$ (from $H_3PO_4$), and 5 ppm of the polymer described in the text above. In Example 2 the composition further included 5 ppm of PBTC (2-phosphonobutane-1,2,4-tricarboxylic acid). In Example 3 the composition further included 5 ppm HEDP (hydroxyethylidene diphosphonic acid). The metal loss versus pH results are set out below in Table II.

TABLE II

| Example | Metal Loss (ppm) pH 7.5 | pH 8.0 | pH 8.5 | pH 9.0 |
|---|---|---|---|---|
| blank | 88.3 | 75.8 | 86.6 | 99.3 |
| 2 | 10.4 | 13.2 | 13.0 | 27.0 |
| 3 | 9.2 | 6.0 | 7.7 | 23.5 |

PILOT COOLING TOWER TEST

The pilot cooling tower embodies the features of a standard cooling tower and hence permits a determination of water-treatment performance under simulated conditions. The pilot cooling tower also is equipped to control the various factors that have an affect on corrosion rate, such as water composition, velocity, water temperature and pH and the like. In general, the cooling water from a basin flows over eight heat transfer tubes in series and then through a conduit in which is held the test specimens, tubes and coupons, after which it returns to the tower section where it is sprayed over a film-type packing above the basin. The tower section is provided with an upper fan that is thermostatically controlled based on the basin water temperature. The basin has feed inlets for the make-up water, the pH control solution (0.07N $H_2SO_4$), and the treatment chemicals, plus an outlet and pump for the blowdown. Between the basin and heat transfer tubes the pilot cooling tower is equipped with a centrifugal circulation pump and pH and conductivity cells. A flow meter is disposed on the line between the heat transfer tubes and the test specimens. The test conditions used are set forth in Table III below. Any variations from these conditions is noted in the specific examples following.

TABLE III

| | |
|---|---|
| Basin water temperature | 100° F. |
| Return water temperature | 110° F. |
| pH | 7.5 to 9.5 |
| Conductivity | 300 to 8,000 μmhos |
| flow rate | 2.0 gallons per minute (gpm) |
| flow velocity | 3.0 feet per second (ft/s) |
| HTI | 24 hours |
| Test duration | 14 days |
| Cycles of concentration | 4 |
| Make-up Water (ppm) | |
| CaH | 90 |
| MgH | 50 |
| Na | 40 |
| "M" alkalinity | 110 |
| Cl | 63 to 64 |
| $SO_4$ | 48 |
| $SiO_2$ | 0 |

The performance of the water treatment used is monitored both by deposit weight and corrosion rate, the latter of which is determined by specimen weight loss after deposit removal.

EXAMPLE 4

Using the Pilot Cooling Tower Test described above, with an actual pH range of 7.5 to 7.9, a water treatment composition was tested, which treatment comprised the following:

| Component | Use level (ppm) |
|---|---|
| $MoO_4^{-2}$ from $Na_2MoO_4.2H_2O$ | 8.0 to 12.0 |
| ortho $PO_4^{-3}$ from $H_3PO_4$ | 8.0 to 12.0 |
| PBTC | 2.0 to 3.0 |
| tolyltriazole | 2.2 to 4.8 |
| diacid | 0.7 to 1.5 |
| polymer | 7.0 to 15.0 |

The diacid used was a fatty acid for stabilization of the tolyltriazole and is such as such subsequently. Both tubes and coupons were used as test specimens. The deposit weights and corrosion rates for the various test specimens are set out below in Table IV.

TABLE IV

| Type of Test Specimen | Deposit Weight (g) | Corrosion Rate (mpy) |
|---|---|---|
| Admiralty brass tube | 16.5 | 0.228 |
| Admiralty brass tube | 21.0 | 0.219 |
| Mild steel tube | 311.8 | 2.156 |
| Mild steel tube | 354.0 | 2.391 |
| Mild steel tube | 374.0 | 2.246 |
| Stainless steel tube | 5.2 | 0.001 |
| Admiralty brass coupon | 2.4 | 0.229 |
| Mild steel coupon | 30.6 | 3.714 |

EXAMPLE 5

The Pilot Cooling Tower Test described in Example 4 above was repeated except the actual pH range was 8.4 to 8.8 and the use levels of the water treatment composition components changed to the following:

| Component | Use level (ppm) |
|---|---|
| $MoO_4^{-2}$ | 4.0 to 8.0 |
| ortho $PO_4^{-3}$ | 4.0 to 8.0 |
| PBTC | 1.0 to 2.0 |
| tolyltriazole | 2.4 to 4.8 |
| diacid | 0.75 to 1.5 |
| polymer | 7.5 to 15.0 |

In this test the components and source thereof are as described in Example 4 above. The type of test specimens, deposit weights, and corrosion rates for this test are set out below in Table V.

TABLE V

| Type of Test Specimen | Deposit Weight (g) | Corrosion Rate (mpy) |
|---|---|---|
| Admiralty brass tube | 42.5 | 0.341 |
| Admiralty brass tube | 47.0 | 0.283 |
| Stainless steel tube | 19.4 | 0.000 |
| Mild steel tube | 266.8 | 1.415 |
| Mild steel tube | 303.0 | 1.611 |
| Mild steel tube | 191.4 | 1.012 |
| Admiralty brass coupon | 2.8 | 0.194 |
| Mild steel coupon | 21.1 | 2.071 |

EXAMPLE 6

The Pilot Cooling Tower Test described in Example 4 above was again repeated except the actual pH range was 7.9 to 8.5 and the basin and return water temperatures were respectively 120° and 130° F., and the use levels of the water treatment composition changed to the following:

| Component | Use level (ppm) |
|---|---|
| $MoO_4^{-2}$ | 5.0 to 10.0 |
| ortho $PO_4^{-3}$ | 12.0 to 24.0 |
| PBTC | 6.0 to 12.0 |
| tolyltriazole | 2.4 to 4.8 |
| diacid | 0.75 to 1.5 |
| polymer | 7.5 to 15.0 |

In this test the components and source thereof are as described in Example above. The type of test specimens, deposit weights, and corrosion rates for this test are set out below in Table VI.

TABLE IV

| Type of Test Specimen | Deposit Weight (g) | Corrosion Rate (mpy) |
|---|---|---|
| Admiralty brass tube | 31.0 | 0.254 |
| Admiralty brass tube | 48.0 | 0.341 |
| Stainless steel tube | 14.0 | 0.000 |
| Mild steel tube | 354.6 | 2.176 |
| Mild steel tube | 368.4 | 2.268 |
| Mild steel tube | 322.2 | 1.552 |
| Admiralty brass coupon | 6.5 | 0.430 |
| Mild steel coupon | 23.1 | 1.987 |

INDUSTRIAL APPLICABILITY OF THE INVENTION

The present invention is applicable to industries employing aqueous systems in contact with metal(s) subject to corrosion, and in particular to the cooling water industries, and more particularly to recirculating cooling water industries.

We claim:

1. A water treatment composition for the inhibition of corrosion in metals in contact with aqueous systems consisting of:

a water-soluble source of molybdate ion; and a water-soluble polymer containing pendant amide functionality, said pendant amide functionality having the structure of

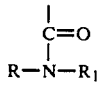

wherein the carbonyl carbon is bonded to the backbone of said water-soluble polymer and R and $R_1$ are independently H or alkyl having 1 to 6 carbons, provided that not both of R and $R_1$ are H.

2. The water treatment composition of claim 1 wherein said water-soluble polymer is a co- or terpolymer of from 25 to 95 mole percent (meth)acrylic acid and from 5 to 75 mole percent alkyl substituted acrylamide, said alkyl substituted acrylamide providing the pendant amide functionality.

3. The water treatment composition of claim 2 wherein said water-soluble polymer is a terpolymer of from 40 to 80 mole percent acrylic acid, from 5 to 40 mole percent methacrylic acid, and from 5 to 40 mole percent tertiary butyl acrylamide.

4. The water treatment composition of claim 1 wherein said water-soluble polymer has a molecular weight of from 500 to 100,000.

5. The water treatment composition of claim 2 wherein said water-soluble polymer has a molecular weight of from 500 to 25,000.

6. The water treatment composition of claim 1 wherein said source of molybdate ion and said water-soluble polymer are present in sufficient relative amounts to provide from 0.5 to 200 ppm molybdate ion and from 0.5 to 200 ppm of said water-soluble polymer when added to an aqueous system.

7. A process for inhibiting corrosion of metals in contact with aqueous systems comprising the addition to the water of such system an effective amount of a water treatment composition as defined in claim 1.

8. The process of claim 7 wherein said water treatment composition is as defined in claim 2.

9. The process of claim 8 wherein said water treatment composition is as defined in claim 3.

10. The process of claim 7 wherein said water treatment composition is as defined in claim 4.

11. The process of claim 8 wherein said water treatment composition is as defined in claim 5.

12. The process of claim 7 wherein sufficient water treatment composition is added to maintain a level of from 0.5 to 200 ppm molybdate ion and from 0.5 to 200 ppm of said water-soluble polymer in said aqueous system.

13. The process of claim 12 wherein sufficient water treatment composition is added to maintain a level of from 5.0 to 150 ppm molybdate ion and from 5 to 150 ppm of said water-soluble polymer in said aqueous system.

14. The process of claim 13 wherein sufficient water treatment composition is added to maintain a level of from 10 to 100 ppm molybdate ion and from 10 to 100 ppm of said water-soluble polymer in said aqueous system.

15. The process of claim 12 wherein the pH of said aqueous system is maintained at from 7.5 to 9.0.

16. The process of claim 12 wherein the temperature of the water in said aqueous system is maintained between 80° to 150° F.

17. A water treatment composition for the inhibition of corrosion in metals in contact with aqueous systems consisting essentially of:

a water-soluble source of molybdate ion;

a water-soluble co- or terpolymer of from 25 to 95 mole percent (meth)acrylic acid and from 5 to 75 mole percent alkyl substituted acrylamide, said alkyl substituted acrylamide being an acrylamide unit substituted at the amide nitrogen with alkyl having from one to six carbons, and said water-soluble co- or terpolymer having a molecular weight of from 500 to 100,000; and at least one of an organic phosphonate, a source of orthophosphate ion, and an azole.

18. The water treatment composition of claim 17 wherein said water-soluble co- or terpolymer is a terpolymer of from about 25 to 90 mole percent acrylic and methacrylic acid and from 5 to 75 mole percent tertiary butyl acrylamide.

19. The water treatment composition of claim 17 wherein said water-soluble co- or terpolymer has a molecular weight of from 500 to 25,000.

20. A process for inhibiting corrosion of metals in contact with aqueous system comprising the addition to the water of such system an effective amount of a water treatment composition as defined in claim 17.

21. The process of claim 20 wherein the pH of said aqueous system is maintained at from 7.5 to 9.0.

22. The process of claim 20 wherein the temperature of the water in said aqueous system is maintained between 80° to 150° F.

23. The water treatment composition of claim 17 consisting essentially of said water-soluble source of molybdate ion, said water-soluble co- or terpolymer, and said source of orthophosphate ion.

* * * * *

UNITED STATES PATENT AND TRADEMARK OFFICE

CERTIFICATE OF CORRECTION

PATENT NO. : 5,002,697

DATED : Mar. 26, 1991

INVENTOR(S) : Guy A. Crucil and Daniel A. Meier

It is certified that error appears in the above-identified patent and that said Letters Patent is hereby corrected as shown below:

In Claim 1, col. 8, line 26, insert after "polymer" and before "containing" -- having a molecular weight of 500 to 100,000 --.

In Claim 7, col. 8, line 64, delete "comprising" and substitute therefor -- consisting of --.

Signed and Sealed this

Twenty-first Day of July, 1992

*Attest:*

DOUGLAS B. COMER

*Attesting Officer*

*Acting Commissioner of Patents and Trademarks*